US011649409B1

(12) United States Patent
Al-Mana et al.

(10) Patent No.: US 11,649,409 B1
(45) Date of Patent: May 16, 2023

(54) PROCESS FOR UPGRADING PYGAS FEED BY AROMATIZING NON-AROMATICS TO BTX

(71) Applicant: Saudi Arabian Oil Company, Dhahran (SA)

(72) Inventors: Noor Nasser Al-Mana, Dhahran (SA); Zhonglin Zhang, Dhahran (SA); Omer Refa Koseoglu, Dhahran (SA); Sohel Shaikh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/567,457

(22) Filed: Jan. 3, 2022

(51) Int. Cl.
*C10G 69/02* (2006.01)
*C10G 67/02* (2006.01)
*C10G 69/12* (2006.01)

(52) U.S. Cl.
CPC ..... *C10G 69/02* (2013.01); *C10G 69/12* (2013.01); *C10G 2300/104* (2013.01); *C10G 2300/4006* (2013.01); *C10G 2300/4012* (2013.01); *C10G 2300/4018* (2013.01); *C10G 2400/30* (2013.01)

(58) Field of Classification Search
CPC .. C10G 69/02; C10G 69/12; C10G 2300/104; C10G 2300/4006; C10G 2300/4012; C10G 2300/4018; C10G 2400/30
See application file for complete search history.

(56) References Cited

U.S. PATENT DOCUMENTS

| | | | | |
|---|---|---|---|---|
| 3,843,740 | A * | 10/1974 | Mitchell | C10G 35/095 585/407 |
| 3,953,366 | A | 4/1976 | Morrison | |
| 4,097,367 | A * | 6/1978 | Haag | B01J 29/74 585/407 |
| 4,304,657 | A | 12/1981 | Miller | |
| 4,499,316 | A | 2/1985 | Garska et al. | |
| 5,665,223 | A * | 9/1997 | Bogdan | B01J 23/63 502/352 |
| 5,895,828 | A | 4/1999 | Yao et al. | |
| 5,898,089 | A | 4/1999 | Drake et al. | |
| 6,635,792 | B2 | 10/2003 | Choi et al. | |
| 6,740,788 | B1 * | 5/2004 | Maher | C07C 6/126 585/475 |
| 9,181,146 | B2 | 11/2015 | Iaccino et al. | |
| 9,181,147 | B2 | 11/2015 | Iaccino et al. | |
| 2008/0194900 | A1 * | 8/2008 | Bhirud | C10G 45/02 585/648 |

FOREIGN PATENT DOCUMENTS

JP S6341592 A 2/1988

* cited by examiner

*Primary Examiner* — In Suk C Bullock
*Assistant Examiner* — Jason Y Chong
(74) *Attorney, Agent, or Firm* — Dinsmore & Shohl LLP

(57) ABSTRACT

In accordance with one or more embodiments of the present disclosure, a method for producing aromatic compounds from pyrolysis gasoline includes hydrotreating a stream comprising the pyrolysis gasoline, thereby producing a hydrotreated pyrolysis gasoline stream comprising paraffins; aromatizing the hydrotreated pyrolysis gasoline stream comprising paraffins, thereby producing a stream comprising benzene-toluene-xylenes (BTX); and processing the stream comprising BTX in an aromatics recovery complex, thereby producing the aromatic compounds from the pyrolysis gasoline.

19 Claims, 3 Drawing Sheets

PROCESS FOR UPGRADING PYGAS FEED BY AROMATIZING NON-AROMATICS TO BTX

FIELD

Embodiments of the present disclosure generally relate to refining and upgrading hydrocarbon oil, and pertain particularly to a process producing aromatic compounds from pyrolysis gasoline.

TECHNICAL BACKGROUND

Steam cracking of gaseous hydrocarbons (ethane, propane, and the butanes) and liquid hydrocarbons (such as light naphtha having five or six carbon atoms) may be used for the production of ethylene. In the process, the feedstocks are diluted with steam and then sent to steam cracker furnaces. Steam cracking is a complex process followed by cooling, compression, and separation steps. Coking is an unwanted side reaction from steam cracking. Coking is a major operational problem in the radiant section of steam cracker furnaces and transfer line exchangers. However, coking can be somewhat controlled by steam dilution, which lowers the hydrocarbon partial pressure of the cracked compounds, thereby favoring the formation of primary reaction products. Indeed, the addition of steam reduces the tendency of coke deposition on the furnace surfaces.

Steam cracking produces $C_1$-$C_4$ light gases, including olefins such as ethylene, propylene, and the butylenes, and liquid products, including pyrolysis gasoline and fuel oil. The product composition depends on the feedstock used. For example, ethane crackers primarily produce ethylene and only small amounts of co-products, whereas naphtha crackers produce a range of olefins and aromatic compounds ("aromatics"), including butadiene, propylene and benzene.

Pyrolysis gasoline ("pygas") contains naphtha-range boiling hydrocarbons (such as from 36° C. to 205° C.) or $C_5$-$C_{12}$ hydrocarbons. In particular, pygas contains the relatively more valuable aromatics and $C_1$-$C_4$ paraffins and olefins, as well as the relatively lower value $C_5$ and greater non-aromatics. Because pygas contains a high concentration of aromatics, it has a high octane number and can be used as a gasoline blending component. It may also be a good source of benzene-toluene-xylenes ("BTX") and other aromatic compounds. However, the recovered amount of these higher value aromatics is limited by the amount of lower value $C_5$ and greater non-aromatics contained in the pygas.

SUMMARY

Therefore, there is a continual need for systems and processes for increasing the amount of higher value aromatics recovered from pygas upgrading. Described herein are processes and systems that allow for the recovery of an increased amount of aromatics as compared with the amount of aromatics recovered by other processes.

According to an embodiment, a method for producing aromatic compounds from pyrolysis gasoline includes hydrotreating a stream comprising the pyrolysis gasoline, thereby producing a hydrotreated pyrolysis gasoline stream comprising paraffins; aromatizing the hydrotreated pyrolysis gasoline stream comprising paraffins, thereby producing a stream comprising benzene-toluene-xylenes (BTX); and processing the stream comprising BTX in an aromatics recovery complex, thereby producing the aromatic compounds from the pyrolysis gasoline.

Additional features and advantages of the embodiments described herein will be set forth in the detailed description which follows, and in part will be readily apparent to those skilled in the art from that description or recognized by practicing the embodiments described, including the detailed description and the claims which are provided infra.

BRIEF DESCRIPTION OF THE DRAWINGS

The following detailed description of specific embodiments of the present disclosure can be best understood when read in conjunction with the following drawings in which.

DETAILED DESCRIPTION

Figure 1:
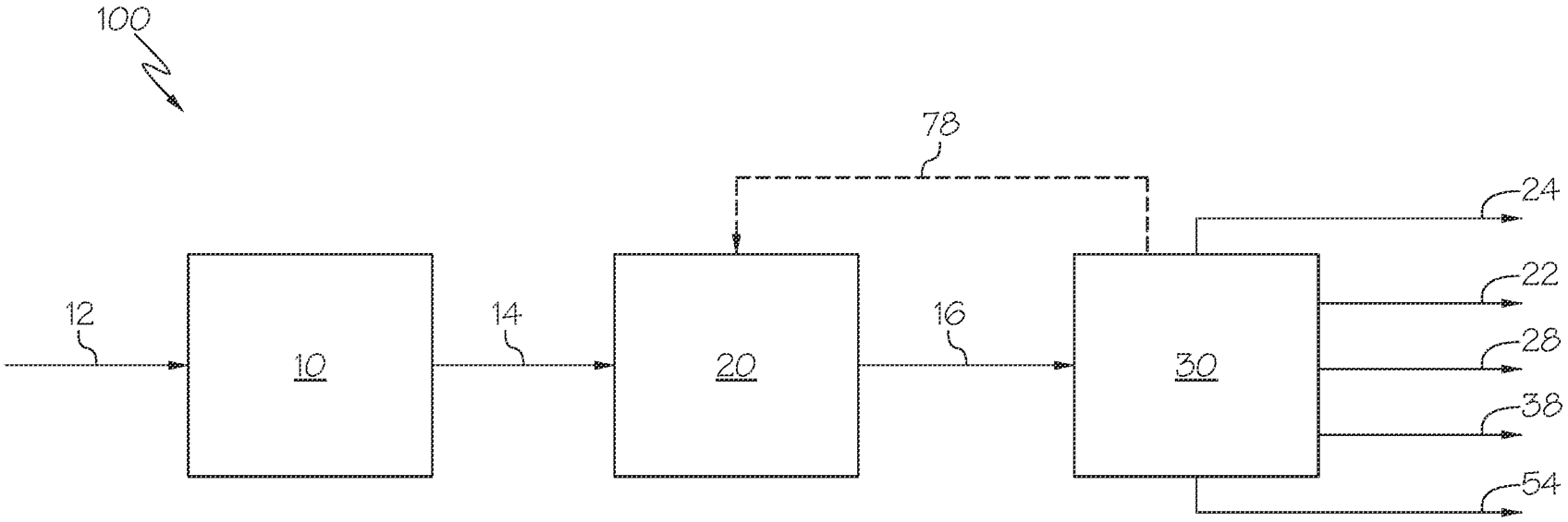
FIG. 1 is a process flow diagram for an exemplary process in accordance with embodiments described herein.

As used herein, the term "hydrocarbon oil" or "hydrocarbon feedstock" refers to an oily liquid composed mostly of a mixture of hydrocarbon compounds. Hydrocarbon oil may include refined oil obtained from crude oil, synthetic crude oil, bitumen, oil sand, shale oil, or coal oil. The term "refined oil" includes, but is not limited to, vacuum gas oil (VGO), deasphalted oil (DAO) obtained from a solvent deasphalting process, demetallized oil (DMO), light and/or heavy coker gas oil obtained from a coker process, cycle oil obtained from a fluid catalytic cracking (FCC) process, and gas oil obtained from a visbreaking process.

As used herein, the term "hydrocarbon" refers to a chemical compound composed entirely of carbon and hydrogen atoms. An expression such as "Cr-Cy hydrocarbon" refers to a hydrocarbon having from x to y carbon atoms. For instance, a $C_1$-$C_5$ hydrocarbon includes methane, ethane, propane, the butanes, and the pentanes.

As used herein, the term "liquid hourly space velocity" or "LHSV" refers to the ratio of the liquid flow rate of the hydrocarbon feed to the catalyst volume or mass.

As used herein, the term "weight hourly space velocity" or "WHSV" refers to the ratio of the weight of reagent flow to the catalyst weight.

As used herein, the term "conduit" includes casings, liners, pipes, tubes, coiled tubing, and mechanical structures with interior voids.

As used herein, the term "decreased content" of a substance means that a concentration of the substance is greater before passing through a stage of the process under examination than it is after passing through the stage. As used herein, the term "increased content" of a substance means that a concentration of the substance is greater after passing through a stage of the process under examination than it is before passing through the stage.

As used herein, any stream that is referred to as "rich" in some chemical species contains 50% or more by volume of that chemical species.

In accordance with one or more embodiments, the present application discloses systems and methods for producing aromatic compounds from pyrolysis gasoline. The method includes hydrotreating a stream comprising the pyrolysis gasoline, thereby producing a hydrotreated pyrolysis gasoline stream comprising paraffins; aromatizing the hydrotreated pyrolysis gasoline stream comprising paraffins, thereby producing a stream comprising BTX; and processing the stream comprising BTX in an aromatics recovery complex ("ARC"), thereby producing the aromatic compounds from the pyrolysis gasoline. This process will now be described in greater detail.

Pygas may undergo hydrotreatment to decrease the content of di-olefins and mono-olefins relative to the starting pygas stream. For instance, in some embodiments the hydrotreated pygas stream may not contain any di-olefins or mono-olefins. In other embodiments, the hydrotreated pygas stream may contain from 0 ppm to 100 ppm di-olefins and mono-olefins, such as from 10 ppm to 90 ppm di-olefins and mono-olefins or from 50 ppm to 90 ppm di-olefins and mono-olefins or from 60 ppm to 80 ppm di-olefins and mono-olefins or about 70 ppm di-olefins and mono-olefins.

In embodiments, the hydrotreatment may take place in a reactor selected from the group consisting of a fixed-bed reactor, an ebullated-bed reactor, a moving bed reactor, a slurry bed reactor, and a combination of two or more thereof. The reactor may include a catalyst composition that includes an active-phase metal on a support. In embodiments, the active-phase metal may be selected from the group consisting of nickel, molybdenum, tungsten, platinum, palladium, rhodium, ruthenium, gold, and a combination of two or more of these. In embodiments, the support may be selected from the group consisting of amorphous alumina, crystalline silica-alumina, alumina, silica, and a combination of two or more thereof. In embodiments, hydrotreatment may take place at a temperature from 200° C. to 400° C., a pressure from 2 MPa to 10 MPa, a LHSV from 1 $h^{-1}$ to 8 $h^{-1}$, and a hydrogen-to-oil ratio from 100 L/L to 2000 L/L.

Pyrolysis hydrotreatment processes may remove the olefins in one step or two steps depending upon the di-olefin and mono-olefin concentrations within the untreated pygas stream. Di-olefin hydrogenation may take place at significantly lower pressures and/or temperatures than mono-olefin hydrogenation. Thus, di-olefins may be selectively hydrogenated prior to the hydrogenation of mono-olefins, with the di-olefins being converted to mono-olefins in this first step. An optional second step, then, may be a higher-pressure and/or higher temperature selective mono-olefin removal step.

In embodiments, hydrogenation of the di-olefins may take place in a reactor at a temperature from 160° C. to 220° C. The temperature for hydrogenation of di-olefins may be, for example, from 160° C. to 210° C., from 160° C. to 200° C., from 160° C. to 190° C., from 160° C. to 180° C., from 160° C. to 170° C., from 170° C. to 220° C., from 180° C. to 220° C., from 190° C. to 220° C., from 200° C. to 220° C., or even from 210° C. to 220° C. It should be understood that the temperature may be from any lower bound for such temperature disclosed herein to any upper bound for such temperature disclosed herein. Without intending to be bound by any particular theory, it is believed that having a reactor temperature below 160° C. may cause the hydrogenation to proceed too slowly to be commercially viable, but having a reactor temperature above 220° C. may cause the di-olefins to polymerize, thereby blocking the catalyst pores.

The hydrogen pressure at the inlet of the reactor in which hydrogenation of di-olefins takes place may be from 1 MPa to 2 MPa, from 1 MPa to 1.9 MPa, from 1 MPa to 1.8 MPa, from 1 MPa to 1.7 MPa, from 1 MPa to 1.6 MPa, from 1 MPa to 1.5 MPa, from 1 MPa to 1.4 MPa, from 1 MPa to 1.3 MPa, from 1 MPa to 1.2 MPa, from 1 MPa to 1.1 MPa, from 1.1 MPa to 2 MPa, from 1.2 MPa to 2 MPa, from 1.3 MPa to 2 MPa, from 1.4 MPa to 2 MPa, from 1.5 MPa to 2 MPa, from 1.6 MPa to 2 MPa, from 1.7 MPa to 2 MPa, from 1.8 MPa to 2 MPa, or even from 1.9 MPa to 2 MPa. It should be understood that the hydrogen pressure may be from any lower bound for such pressure disclosed herein to any upper bound for such pressure disclosed herein. Without intending to be bound by any particular theory, it is believed that a hydrogen partial pressure below 1 MPa may be insufficient for the hydrogenation to take place and lead to a faster deactivation of the catalyst. However, at a hydrogen partial pressure above 2 MPa, specialized high-pressure equipment may become necessary, which would increase the cost of performing the hydrogenation.

In embodiments, the reactor used for hydrogenation of di-olefins may be operated at a WHSV from 1 $h^{-1}$ to 2 $h^{-1}$, from 1 $h^{-1}$ to 1.9 $h^{-1}$, from 1 $h^{-1}$ to 1.8 $h^{-1}$, from 1 $h^{-1}$ to 1.7 $h^{-1}$, from 1 $h^{-1}$ to 1.6 $h^{-1}$, from 1 $h^{-1}$ to 1.5 $h^{-1}$, from 1 $h^{-1}$ to 1.4 $h^{-1}$, from 1 $h^{-1}$ to 1.3 $h^{-1}$, from 1 $h^{-1}$ to 1.2 $h^{-1}$, from 1 $h^{-1}$ to 1.1 $h^{-1}$, from 1.1 $h^{-1}$ to 2 $h^{-1}$, from 1.2 $h^{-1}$ to 2 $h^{-1}$, from 1.3 $h^{-1}$ to 2 $h^{-1}$, from 1.4 $h^{-1}$ to 2 $h^{-1}$, from 1.5 $h^{-1}$ to 2 $h^{-1}$, from 1.6 $h^{-1}$ to 2 $h^{-1}$, from 1.7 $h^{-1}$ to 2 $h^{-1}$, from 1.8 $h^{-1}$ to 2 $h^{-1}$, or even from 1.9 $h^{-1}$ to 2 $h^{-1}$. It should be understood that the WHSV may be from any lower bound for such WHSV disclosed herein to any upper bound for such WHSV disclosed herein. Without intending to be bound by any particular theory, it is believed that a WHSV below 1 $h^{-1}$ may require a catalyst volume and/or reactor volume that is too large to be commercially viable. However, a WHSV above 2 $h^{-1}$ may cause a residence time of the reactants in the reactor that is too short to allow the hydrogenation to proceed.

In embodiments, the hydrogen used for di-olefin hydrogenation may be recycled into the reactor at a hydrogen recycle rate from 50 $N{\cdot}m^3/m^3$ to 150 $N{\cdot}m^3/m^3$, from 50 $N{\cdot}m^3/m^3$ to 140 $N{\cdot}m^3/m^3$, from 50 $N{\cdot}m^3/m^3$ to 130 $N{\cdot}m^3/m^3$, from 50 $N{\cdot}m^3/m^3$ to 120 $N{\cdot}m^3/m^3$, from 50 $N{\cdot}m^3/m^3$ to 110 $N{\cdot}m^3/m^3$, from 50 $N{\cdot}m^3/m^3$ to 100 $N{\cdot}m^3/m^3$, from 50 $N{\cdot}m^3/m^3$ to 90 $N{\cdot}m^3/m^3$, from 50 $N{\cdot}m^3/m^3$ to 80 $N{\cdot}m^3/m^3$, from 50 $N{\cdot}m^3/m^3$ to 70 $N{\cdot}m^3/m^3$, from 50 $N{\cdot}m^3/m^3$ to 60 $N{\cdot}m^3/m^3$, from 60 $N{\cdot}m^3/m^3$ to 150 $N{\cdot}m^3/m^3$, from 70 $N{\cdot}m^3/m^3$ to 150 $N{\cdot}m^3/m^3$, from 80 $N{\cdot}m^3/m^3$ to 150 $N{\cdot}m^3/m^3$, from 90 $N{\cdot}m^3/m^3$ to 150 $N{\cdot}m^3/m^3$, from 100 $N{\cdot}m^3/m^3$ to 150 $N{\cdot}m^3/m^3$, from 110 $N{\cdot}m^3/m^3$ to 150 $N{\cdot}m^3/m^3$, from 120 $N{\cdot}m^3/m^3$ to 150 $N{\cdot}m^3/m^3$, from 130 $N{\cdot}m^3/m^3$ to 150 $N{\cdot}m^3/m^3$, or even from 140 $N{\cdot}m^3/m^3$ to 150 $N{\cdot}m^3/m^3$. It should be understood that the hydrogen recycle rate may be from any lower bound for such hydrogen recycle rate disclosed herein to any upper bound for such hydrogen recycle rate disclosed herein. Without intending to be bound by any particular theory, it is believed that a hydrogen recycle rate less than 50 $N{\cdot}m^3/m^3$ may not allow sufficient levels of hydrogen into the reactor. However, a hydrogen recycle rate greater than 150 $N{\cdot}m^3/m^3$ may cause too much hydrogen to circulate within the system, such that an unacceptable amount of the hydrogen is consumed.

In embodiments, hydrogenation of the mono-olefins may take place in a reactor at a temperature from 270° C. to 330° C. The temperature for hydrogenation of di-olefins may be, for example, from 270° C. to 320° C., from 270° C. to 310° C., from 270° C. to 300° C., from 270° C. to 290° C., from 270° C. to 280° C., from 280° C. to 330° C., from 290° C. to 330° C., from 300° C. to 330° C., from 310° C. to 330° C., or even from 320° C. to 330° C. It should be understood that the temperature may be from any lower bound for such temperature disclosed herein to any upper bound for such temperature disclosed herein. Without intending to be bound by any particular theory, it is believed that having a reactor temperature below 270° C. may cause the hydrogenation of the mono-olefins to proceed too slowly to be commercially viable, but having a reactor temperature above 330° C. may cause polymerization of species found in the reactor, thereby coking the catalyst.

The hydrogen pressure at the inlet of the reactor in which hydrogenation of mono-olefins takes place may be from 1 MPa to 2 MPa, from 1 MPa to 1.9 MPa, from 1 MPa to 1.8 MPa, from 1 MPa to 1.7 MPa, from 1 MPa to 1.6 MPa, from 1 MPa to 1.5 MPa, from 1 MPa to 1.4 MPa, from 1 MPa to 1.3 MPa, from 1 MPa to 1.2 MPa, from 1 MPa to 1.1 MPa, from 1.1 MPa to 2 MPa, from 1.2 MPa to 2 MPa, from 1.3 MPa to 2 MPa, from 1.4 MPa to 2 MPa, from 1.5 MPa to 2 MPa, from 1.6 MPa to 2 MPa, from 1.7 MPa to 2 MPa, from 1.8 MPa to 2 MPa, or even from 1.9 MPa to 2 MPa. It should be understood that the hydrogen pressure may be from any lower bound for such pressure disclosed herein to any upper bound for such pressure disclosed herein. Without intending to be bound by any particular theory, it is believed that a hydrogen partial pressure below 1 MPa may be insufficient for the hydrogenation to take place and lead to a faster deactivation of the catalyst. However, at a hydrogen partial pressure above 2 MPa, specialized high-pressure equipment may become necessary, which would increase the cost of performing the hydrogenation.

In embodiments, the reactor used for hydrogenation of mono-olefins may be operated at a WHSV from 1 $h^{-1}$ to 2 $h^{-1}$, from 1 $h^{-1}$ to 1.9 $h^{-1}$, from 1 $h^{-1}$ to 1.8 $h^{-1}$, from 1 $h^{-1}$ to 1.7 $h^{-1}$, from 1 $h^{-1}$ to 1.6 $h^{-1}$, from 1 $h^{-1}$ to 1.5 $h^{-1}$, from 1 $h^{-1}$ to 1.4 $h^{-1}$, from 1 $h^{-1}$ to 1.3 $h^{-1}$, from 1 $h^{-1}$ to 1.2 $h^{-1}$, from 1 $h^{-1}$ to 1.1 $h^{-1}$, from 1.1 $h^{-1}$ to 2 $h^{-1}$, from 1.2 $h^{-1}$ to 2 $h^{-1}$, from 1.3 $h^{-1}$ to 2 $h^{-1}$, from 1.4 $h^{-1}$ to 2 $h^{-1}$, from 1.5 $h^{-1}$ to 2 $h^{-1}$, from 1.6 $h^{-1}$ to 2 $h^{-1}$, from 1.7 $h^{-1}$ to 2 $h^{-1}$, from 1.8 $h^{-1}$ to 2 $h^{-1}$, or even from 1.9 $h^{-1}$ to 2 $h^{-1}$. It should be understood that the WHSV may be from any lower bound for such WHSV disclosed herein to any upper bound for such WHSV disclosed herein. Without intending to be bound by any particular theory, it is believed that a WHSV below 1 $h^{-1}$ may require a catalyst volume and/or reactor volume that is too large to be commercially viable. However, a WHSV above 2 $h^{-1}$ may cause a residence time of the reactants in the reactor that is too short to allow the hydrogenation to proceed.

In embodiments, the hydrogen used for di-olefin hydrogenation may be recycled into the reactor at a hydrogen recycle rate from 250 $N \cdot m^3/m^3$ to 750 $N \cdot m^3/m^3$, from 250 $N \cdot m^3/m^3$ to 700 $N \cdot m^3/m^3$, from 250 $N \cdot m^3/m^3$ to 650 $N \cdot m^3/m^3$, from 250 $N \cdot m^3/m^3$ to 600 $N \cdot m^3/m^3$, from 250 $N \cdot m^3/m^3$ to 550 $N \cdot m^3/m^3$, from 250 $N \cdot m^3/m^3$ to 500 $N \cdot m^3/m^3$, from 250 $N \cdot m^3/m^3$ to 450 $N \cdot m^3/m^3$, from 250 $N \cdot m^3/m^3$ to 400 $N \cdot m^3/m^3$, from 250 $N \cdot m^3/m^3$ to 350 $N \cdot m^3/m^3$, from 250 $N \cdot m^3/m^3$ to 300 $N \cdot m^3/m^3$, from 300 $N \cdot m^3/m^3$ to 750 $N \cdot m^3/m^3$, from 350 $N \cdot m^3/m^3$ to 750 $N \cdot m^3/m^3$, from 400 $N \cdot m^3/m^3$ to 750 $N \cdot m^3/m^3$, from 450 $N \cdot m^3/m^3$ to 750 $N \cdot m^3/m^3$, from 500 $N \cdot m^3/m^3$ to 750 $N \cdot m^3/m^3$, from 550 $N \cdot m^3/m^3$ to 750 $N \cdot m^3/m^3$, from 600 $N \cdot m^3/m^3$ to 750 $N \cdot m^3/m^3$, from 650 $N \cdot m^3/m^3$ to 750 $N \cdot m^3/m^3$, or even from 700 $N \cdot m^3/m^3$ to 750 $N \cdot m^3/m^3$. It should be understood that the hydrogen recycle rate may be from any lower bound for such hydrogen recycle rate disclosed herein to any upper bound for such hydrogen recycle rate disclosed herein. Without intending to be bound by any particular theory, it is believed that a hydrogen recycle rate less than 250 $N \cdot m^3/m^3$ may not allow sufficient levels of hydrogen into the reactor. However, a hydrogen recycle rate greater than 750 $N \cdot m^3/m^3$ may cause too much hydrogen to circulate within the system, such that an unacceptable amount of the hydrogen is consumed.

After hydrotreating, the hydrotreated pyrolysis gasoline stream comprising paraffins may be aromatized in an aromatization unit, thereby producing a stream comprising BTX. In the aromatization unit, the paraffins are converted, at least partially, to BTX by undergoing cyclization, dealkylation, and/or hydrodealkylation reactions. In embodiments, the aromatizing may include contacting the hydrotreated pyrolysis gasoline stream with a catalyst comprising a zeolite. In embodiments, the zeolite may include a Y-type zeolite, a ZSM-5-type zeolite, or a combination of the Y-type zeolite and the ZSM-5-type zeolite. In embodiments, a single reactor may be used for all of cyclization, dealkylation, and hydrodealkylation. In other embodiments, more than one reactor, such as two reactors, may be used to perform cyclization, dealkylation, and hydrodealkylation. For instance, one reactor may be used for cyclization and another reactor may be used for dealkylation and/or hydrodealkylation. In embodiments using more than one reactor, the catalyst may be the same or different in each reactor. Further, the temperature, pressure, and WHSV may all be the same or different in each reactor.

In embodiments, the aromatization unit may be operated at a temperature from 200° C. to 700° C., from 200° C. to 650° C., from 200° C. to 600° C., from 200° C. to 550° C., from 200° C. to 500° C., from 200° C. to 450° C., from 200° C. to 400° C., from 200° C. to 350° C., from 200° C. to 300° C., from 200° C. to 250° C., from 250° C. to 700° C., from 300° C. to 950° C., from 350° C. to 700° C., from 400° C. to 700° C., from 450° C. to 700° C., from 450° C. to 650° C., from 500° C. to 700° C., from 500° C. to 600° C., from 525° C. to 575° C., from 550° C. to 700° C., from 600° C. to 700° C., or even from 650° C. to 700° C. It should be understood that the temperature may be from any lower bound for such temperature disclosed herein to any upper bound for such temperature disclosed herein. Without intending to be bound by any particular theory, it is believed that having a reactor temperature below 200° C. may cause the cyclization, dealkylation, and/or hydrodealkylation reactions to proceed too slowly to be commercially viable, but having a reactor temperature above 700° C. may cause polymerization of species found in the reactor, thereby coking the catalyst.

In embodiments, the aromatization unit may be operated at a pressure from 0.1 MPa to 3 MPa, from 0.1 MPa to 2.9 MPa, from 0.1 MPa to 2.8 MPa, from 0.1 MPa to 2.7 MPa, from 0.1 MPa to 2.6 MPa, from 0.1 MPa to 2.5 MPa, from 0.1 MPa to 2.4 MPa, from 0.1 MPa to 2.3 MPa, from 0.1 MPa to 2.2 MPa, from 0.1 MPa to 2.1 MPa, from 0.1 MPa to 2 MPa, from 0.1 MPa to 1.9 MPa, from 0.1 MPa to 1.8 MPa, from 0.1 MPa to 1.7 MPa, from 0.1 MPa to 1.6 MPa, from 0.1 MPa to 1.5 MPa, from 0.1 MPa to 1.4 MPa, from 0.1 MPa to 1.3 MPa, from 0.1 MPa to 1.2 MPa, from 0.1 MPa to 1.1 MPa, from 0.1 MPa to 1 MPa, from 0.1 MPa to 0.9 MPa, from 0.1 MPa to 0.8 MPa, from 0.1 MPa to 0.7 MPa, from 0.1 MPa to 0.6 MPa, from 0.1 MPa to 0.5 MPa, from 0.1 MPa to 0.4 MPa, from 0.1 MPa to 0.3 MPa, from 0.1 MPa to 0.2 MPa, from 0.2 MPa to 3 MPa, from 0.3 MPa to 3 MPa, from 0.4 MPa to 3 MPa, from 0.5 MPa to 3 MPa, from 0.6 MPa to 3 MPa, from 0.7 MPa to 3 MPa, from 0.8 MPa to 3 MPa, from 0.9 MPa to 3 MPa, from 1 MPa to 3 MPa, from 1.1 MPa to 3 MPa, from 1.2 MPa to 3 MPa, from 1.3 MPa to 3 MPa, from 1.4 MPa to 3 MPa, from 1.5 MPa to 3 MPa, from 1.6 MPa to 3 MPa, from 1.7 MPa to 3 MPa, from 1.8 MPa to 3 MPa, from 1.9 MPa to 3 MPa, from 2 MPa to 3 MPa, from 2.1 MPa to 3 MPa, from 2.2 MPa to 3 MPa, from 2.3 MPa to 3 MPa, from 2.4 MPa to 3 MPa, from 2.5 MPa to 3 MPa, from 2.6 MPa to 3 MPa, from 2.7 MPa to 3 MPa, from 2.8 MPa to 3 MPa, or even from 2.9 MPa to 3 MPa. It should be understood that the operating pressure may be from any lower bound for such pressure disclosed herein to any upper bound for such pressure disclosed herein. Without intending to be bound by any particular theory, it is believed that a pressure below 0.1 MPa may be insufficient for the cyclization, dealkylation, and/or hydrodealkylation to take place. However, at a pressure above 3 MPa, specialized high-pressure equipment may become necessary, which would increase the cost of performing the reaction.

In embodiments, the aromatization unit may be operated at a WHSV from 0.1 $h^{-1}$ to 20 $h^{-1}$, from 0.1 $h^{-1}$ to 19 $h^{-1}$, from 0.1 $h^{-1}$ to 18 $h^{-1}$, from 0.1 $h^{-1}$ to 17 $h^{-1}$, from 0.1 $h^{-1}$ to 16 $h^{-1}$, from 0.1 $h^{-1}$ to 15 $h^{-1}$, from 0.1 $h^{-1}$ to 14 $h^{-1}$, from 0.1 $h^{-1}$ to 13 $h^{-1}$, from 0.1 $h^{-1}$ to 12 $h^{-1}$, from 0.1 $h^{-1}$ to 11 $h^{-1}$, from 0.1 $h^{-1}$ to 10 $h^{-1}$, from 0.1 $h^{-1}$ to 9 $h^{-1}$, from 0.1 $h^{-1}$ to 8 $h^{-1}$, from 0.1 $h^{-1}$ to 7 $h^{-1}$, from 0.1 $h^{-1}$ to 6 $h^{-1}$, from 0.1 $h^{-1}$ to 5 $h^{-1}$, from 0.1 $h^{-1}$ to 4 $h^{-1}$, from 0.1 $h^{-1}$ to 3 $h^{-1}$, from 0.1 $h^{-1}$ to 2 $h^{-1}$, from 0.1 $h^{-1}$ to 1 $h^{-1}$, from 0.5 $h^{-1}$ to 5 $h^{-1}$, from 0.75 $h^{-1}$ to 1.25 $h^{-1}$, from 1 $h^{-1}$ to 20 $h^{-1}$, from 2 $h^{-1}$ to 20 $h^{-1}$, from 3 $h^{-1}$ to 20 $h^{-1}$, from 4 $h^{-1}$ to 20 $h^{-1}$, from 5 $h^{-1}$ to 20 $h^{-1}$, from 6 $h^{-1}$ to 20 $h^{-1}$, from 7 $h^{-1}$ to 20 $h^{-1}$, from 8 $h^{-1}$ to 20 $h^{-1}$, from 9 $h^{-1}$ to 20 $h^{-1}$, from 10 $h^{-1}$ to 20 $h^{-1}$, from 11 $h^{-1}$ to 20 $h^{-1}$, from 12 $h^{-1}$ to 20 $h^{-1}$, from 13 $h^{-1}$ to 20 $h^{-1}$, from 14 $h^{-1}$ to 20 $h^{-1}$, from 15 $h^{-1}$ to 20 $h^{-1}$, from 16 $h^{-1}$ to 20 $h^{-1}$, from 17 $h^{-1}$ to 20 $h^{-1}$, from 18 $h^{-1}$ to 20 $h^{-1}$, or even from 19 $h^{-1}$ to 20 $h^{-1}$. It should be understood that the WHSV may be from any lower bound for such WHSV disclosed herein to any upper bound for such WHSV disclosed herein. Without intending to be bound by any particular theory, it is believed that a WHSV below 0.1 $h^{-1}$ may require a catalyst volume and/or reactor volume that is too large to be commercially viable, or a higher residence time of the reactants may be necessary, thereby leading to a decreased amount of time to catalyst deactivation. However, a WHSV above 20 $h^{-1}$ may cause a residence time of the reactants in the reactor that is too short to allow the hydrogenation to proceed.

The stream comprising BTX may be processed in an ARC where it undergoes several processing steps in order to recover high value products, e.g., xylenes and benzene, and to convert lower value products, e.g., toluene, into higher value products. For example, the aromatics present may be separated into different fractions by carbon number; e.g. benzene, toluene, xylenes, and ethylbenzene, etc. The $C_8$ fraction may then be subjected to a processing scheme to prepare para-xylene ("p-xylene"), which is a high value product. P-xylene may be recovered in high purity from the $C_8$ fraction by separating the p-xylene from the ortho-xylene ("o-xylene"), meta-xylene ("m-xylene"), and ethylbenzene using selective adsorption or crystallization. The o-xylene and m-xylene remaining from the p-xylene separation may be isomerized to produce an equilibrium mixture of xylenes. The ethylbenzene may be isomerized into xylenes or dealkylated to benzene and ethane. The p-xylene of the equilibrium mixture may also be separated from the o-xylene and the m-xylene using adsorption or crystallization, and the p-xylene-depleted stream may be recycled to the isomerization unit and then to the p-xylene recovery unit until all of the o-xylene and m-xylene are converted to p-xylene and recovered, or at least until it is no longer economically feasible to attempt to convert additional p-xylene. Toluene may be recovered as a separate fraction and then may be converted into higher value products, e.g., benzene and/or xylenes. An exemplary toluene conversion process may involve the disproportionation of toluene to make benzene and xylenes. Another exemplary process may involve the hydrodealkylation of toluene to make benzene. An exemplary ARC is disclosed in U.S. Application Publication No. 2018/0066197, the entire content of which is incorporated herein by reference.

In embodiments, toluene may be transalkylated with other alkylaromatics in the stream comprising $C_9$ and greater ("$C_9^+$") species to produce xylenes. In embodiments disclosed herein, the ARC may include a transalkylation unit. In such embodiments, the stream comprising BTX further comprises $C_9$-$C_{10}$ aromatic compounds and the transalkylation unit converts the toluene and the $C_9$-$C_{10}$ aromatic compounds to benzene and xylenes. In other embodiments disclosed herein, the ARC does not include a transalkylation unit. In such embodiments, a separate transalkylation unit may be optionally added downstream of the aromatization unit and upstream of the ARC. The aromatic bottoms fractions from an ARC with no transalkylation unit may be rich in $C_9$ and greater ("$C_9$+") aromatic species, and the aromatic bottoms fractions from an ARC with a transalkylation unit may be rich in $C_{11}$ and greater ("$C_{11}$+") aromatic species.

FIG. 1, provides a process flow diagram for an exemplary process in accordance with embodiments described herein. A pygas upgrading system 100 includes a pygas hydrotreatment unit 10, a pygas aromatization unit 20, and an ARC 30.

Pygas stream 12, from a steam cracker for instance, may be added to the pygas hydrotreatment unit 10, where it may be processed as described above, thereby resulting in a hydrotreated pyrolysis gasoline stream 14. The hydrotreated pyrolysis gasoline stream 14 may be sent to the pygas aromatization unit 20, thereby producing an aromatic-rich stream comprising BTX 16, which may then be sent to an ARC 30 to isolate the BTX.

Figure 2:
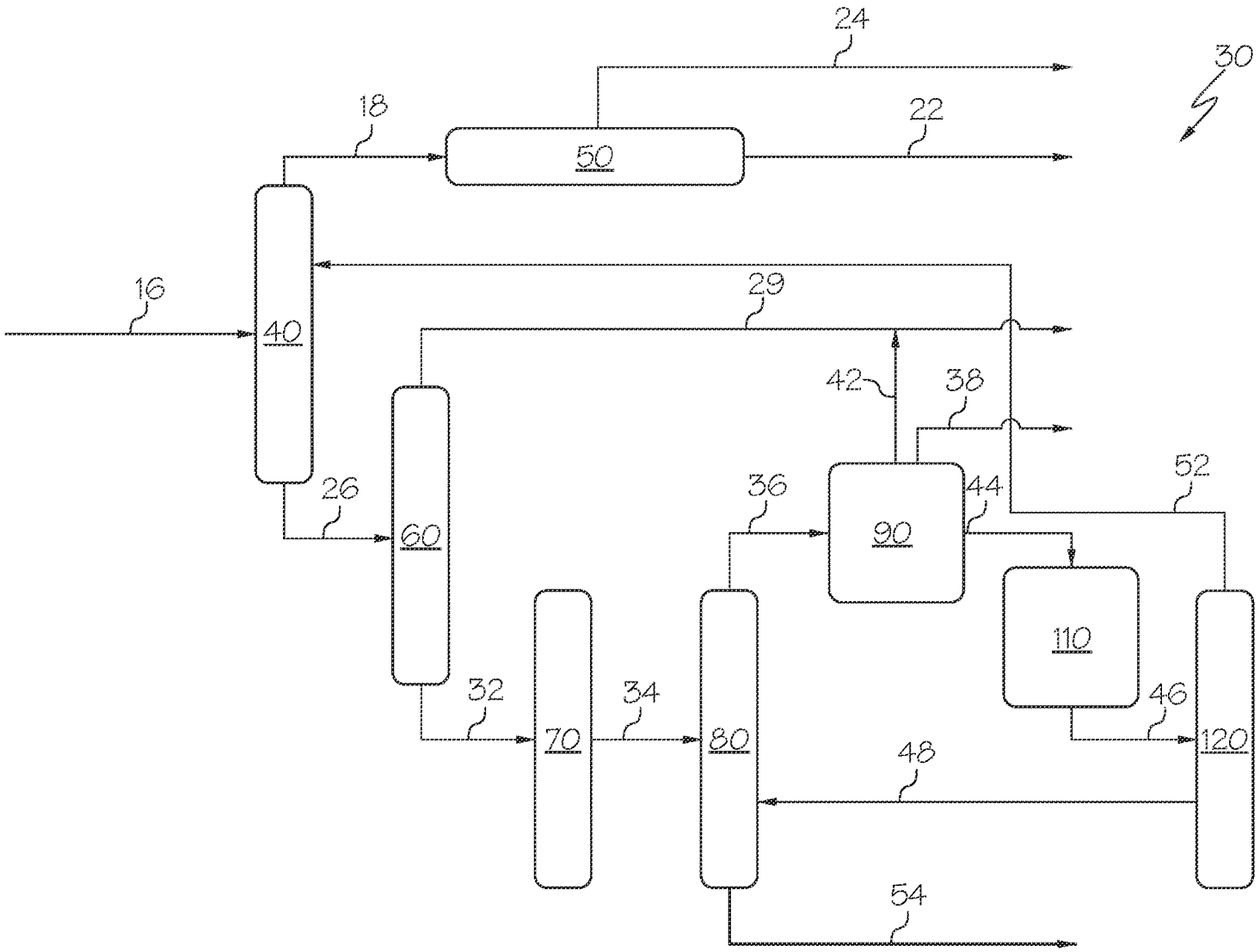
FIG. 2 is a schematic diagram of an exemplary aromatics recovery complex that may be used in accordance with embodiments described herein.

FIG. 2 provides a schematic diagram of an exemplary ARC 30. The aromatic-rich stream comprising BTX 16 may enter ARC 30 and pass into separator 40 to be separated into two fractions: a light reformate stream 18 with $C_5$-$C_6$ hydrocarbons and a heavy reformate stream 26 with $C_7$ and greater ("$C_7$+") hydrocarbons. The light reformate stream 18 may be sent to a benzene extraction unit 50 to extract the benzene stream 22 and to recover substantially benzene-free gasoline as raffinate motor gasoline ("mogas") stream 24 including $C_5$-$C_6$ non-aromatic hydrocarbons. As used herein, the term "substantially benzene-free" refers to a stream that has less than or equal to 1000 ppm benzene. The heavy reformate stream 26 may be sent to a first separator 60, thereby producing a $C_7$ cut mogas stream 29 and a $C_8$ and greater ("$C_8$+) hydrocarbon stream 32, which may be sent to a clay treater 70. The resulting clay treated $C_8$+ stream 34 may be fed to a xylene rerun separation unit 80, which separates the $C_8$+ hydrocarbons into a $C_8$ hydrocarbon stream 36 and a $C_9$+ hydrocarbon stream 54 ("heavy aromatic mogas" or "aromatic bottoms"). The $C_8$ hydrocarbon stream 36 may be sent to a p-xylene extraction unit 90 to recover p-xylene stream 38. P-xylene extraction unit 90 also produces a $C_7$ cut mogas stream 42, which may be added to $C_7$ cut mogas stream 29 from the first separator 60. An o-xylenes and m-xylenes stream 44 may be recovered and sent to xylene isomerization unit 110 to convert them to p-xylene 46, which may be sent to separator 120. The converted fraction 48, which is rich in p-xylenes, may be recycled to xylene rerun separation unit 80. The reformate stream 52 from the second separator 120 may be recycled to separator 40. The heavy fraction from the xylene rerun separation unit 80 may be discharged as process reject or aromatic bottoms stream 54, which is rich in $C_9$+ aromatic hydrocarbons.

Figure 3:
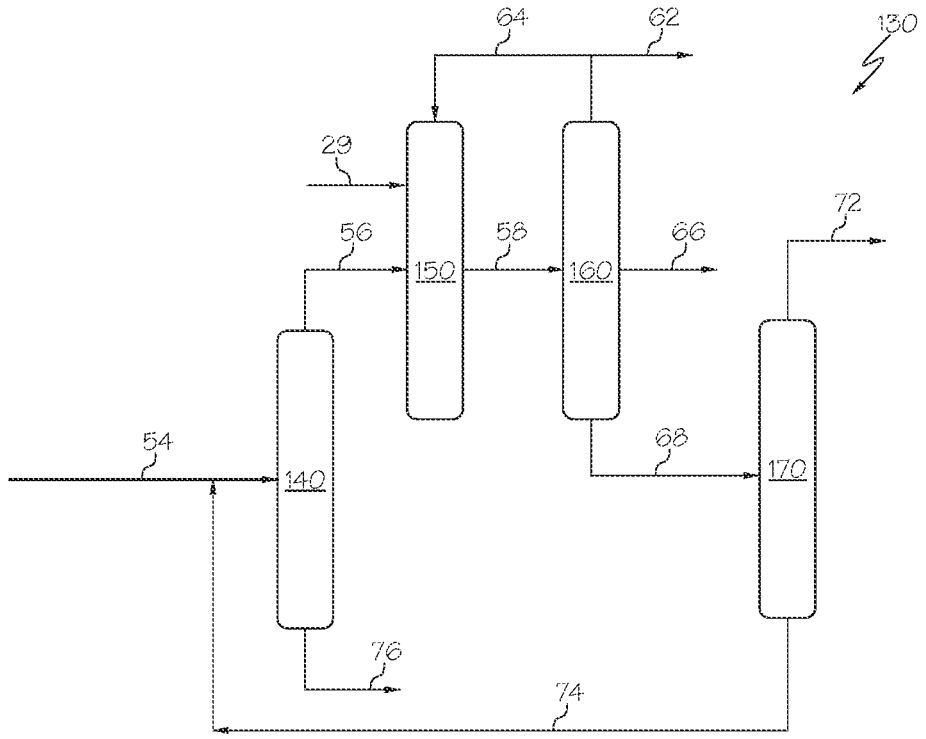
FIG. 3 is a schematic of an exemplary transalkylation unit that may be used in accordance with embodiments described herein.

As noted above, in some embodiments, the ARC 30 may include a transalkylation unit 130. FIG. 3 is a schematic of an exemplary transalkylation unit 130. The aromatics bottoms stream 54 of FIG. 2 is sent to a third separator 140 to separate $C_9$-$C_{10}$ aromatics from $C_{11}$ aromatics. The $C_9$-$C_{10}$ stream 56 and the $C_7$ cut mogas stream 29 of FIG. 2 may be sent to a transalkylation reactor 150, in which the $C_9$-$C_{10}$ and $C_7$ are converted into $C_6$ and $C_8$. The effluents 58 from the transalkylation reactor 150 may be sent to a fourth separator 160 to separate the effluents into three fractions: a benzene rich stream 62, a toluene rich stream 66, and a xylenes rich stream 68. The benzene rich stream 62 may be sent to a benzene recovery unit (not shown), which allows benzene to be recovered as a commodity product, or be recycled to the transalkylation reactor 150 via conduit 64. The toluene rich stream 66 may be recovered and recycled to the transalkylation reactor 150 or withdrawn as a gasoline blending component. The xylene rich stream 68 may be sent to a separator 170 via conduit 68 to obtain a xylenes stream 72, which may be sent to the p-xylene extraction unit 90 of FIG. 2, and a $C_9$+ stream 74 that may be recycled to the third separator 140. The third separator 140 may also produce a $C_{11}$ aromatics rich stream 76.

Returning to FIG. 1, once the aromatic-rich stream 16 has passed through the ARC 30, with or without a transalkylation unit, the desired products, including BTX, may be extracted from the ARC 30. For instance, one or more of the raffinate mogas stream 24 ("$C_5$-$C_6$ non-aromatic hydrocarbons"), the benzene stream 22 ("$C_6$"), the toluene stream 28 ("$C_7$"), the xylenes stream 38 ("$C_8$" including p-xylenes), and the aromatic bottoms stream 54 ("$C_9$ and greater") may be collected, as shown in FIG. 1. Furthermore, in embodiments, the raffinate mogas stream 78 may be recycled to pygas aromatization unit 20, thereby increasing the yield of BTX.

Advantageously, the processes and systems described herein allow for the production of valuable BTX from pygas. Overall, the production of and BTX is greatly improved relative to processes and systems lacking the pygas aromatization unit prior to aromatics recovery.

According to an aspect, either alone or in combination with any other aspect, a method for producing aromatic compounds from pyrolysis gasoline includes hydrotreating a stream comprising the pyrolysis gasoline, thereby producing a hydrotreated pyrolysis gasoline stream comprising paraffins; aromatizing the hydrotreated pyrolysis gasoline stream comprising paraffins, thereby producing a stream comprising benzene-toluene-xylenes (BTX); and processing the stream comprising BTX in an aromatics recovery complex, thereby producing the aromatic compounds from the pyrolysis gasoline.

According to a second aspect, either alone or in combination with any other aspect, the aromatics recovery complex does not comprise a transalkylation unit.

According to a third aspect, either alone or in combination with any other aspect, the method further comprises transalkylating the stream comprising BTX prior to the processing.

According to a fourth aspect, either alone or in combination with any other aspect, the aromatics recovery complex comprises a transalkylation unit.

According to a fifth aspect, either alone or in combination with any other aspect, the stream comprising BTX further comprises $C_9$-$C_{10}$ aromatic compounds and the transalkylation unit converts the toluene and the $C_9$-$C_{10}$ aromatic compounds to benzene and xylenes.

According to a sixth aspect, either alone or in combination with any other aspect, the aromatizing comprises one or more of cyclization, dealkylation, and hydrodealkylation reactions.

According to a seventh aspect, either alone or in combination with any other aspect, the aromatizing is performed in a reactor having a temperature from 200° C. to 900° C.

According to an eighth aspect, either alone or in combination with any other aspect, the aromatizing is performed in a reactor having a weight hour space velocity from 0.1 $h^{-1}$ to 20 $h^{-1}$.

According to a ninth aspect, either alone or in combination with any other aspect, the aromatizing is performed in a reactor having a pressure from 0.1 MPa to 3 MPa.

According to a tenth aspect, either alone or in combination with any other aspect, the aromatizing comprises contacting the hydrotreated pyrolysis gasoline stream with a catalyst comprising a Y-type zeolite, a ZSM-5-type zeolite, or a combination of the Y-type zeolite and the ZSM-5-type zeolite.

According to an eleventh aspect, either alone or in combination with any other aspect, the aromatics recovery complex further produces $C_5$-$C_6$ non-aromatic compounds.

According to a twelfth aspect, either alone or in combination with any other aspect, the method further comprises aromatizing the $C_5$-$C_6$ non-aromatic compounds, thereby producing BTX, the BTX being added to the stream comprising benzene-toluene-xylenes (BTX).

EXAMPLES

Using embodiments described above, an exemplary upgrading system and process was simulated using the HYSIS simulator, as follows. The following examples are merely illustrative and should not be interpreted as limiting the scope of the present disclosure.

HYSIS v. 10.0 was used to simulate the material balance for system without a pygas aromatization unit (comparative), the system shown in FIG. 1 without a transalkylation unit in the ARC, and the system shown in FIG. 1 with a transalkylation unit in the ARC. The simulated conditions included a reactor temperature of 550° C., a reactor pressure of 0.1 MPa, and a WHSV of 1 $h^{-1}$. Table 1 provides the simulated material balance for the comparative system. Table 2 provides the simulated material balance for the inventive system without a transalkylation unit associated with the ARC. Table 3 provides the simulated material balance for the inventive system with a transalkylation unit associated with the ARC.

TABLE 1

Material balance for comparative system without an aromatization unit (all values in kg)

| Species | In | After HT | Raffinate | $C_6$-rich | $C_7$-rich | $C_8$-rich | Aromatic Bottoms |
|---|---|---|---|---|---|---|---|
| $H_2$ | 0.0 | 0.0 | 0.0 | 0.0 | 0.0 | 0.0 | 0.0 |
| $C_1$-$C_4$ | 0.0 | 0.0 | 0.0 | 0.0 | 0.0 | 0.0 | 0.0 |
| $C_5$+ paraffins | 19.17 | 35.36 | 35.36 | 0.0 | 0.0 | 0.0 | 0.0 |
| Naphthenes | 2.34 | 2.34 | 2.34 | 0.0 | 0.0 | 0.0 | 0.0 |
| Mono-olefins | 7.69 | 0.0 | 0.0 | 0.0 | 0.0 | 0.0 | 0.0 |
| Di-olefins | 8.5 | 0.0 | 0.0 | 0.0 | 0.0 | 0.0 | 0.0 |
| Benzene | 34.2 | 34.2 | 0.0 | 34.2 | 0.0 | 0.0 | 0.0 |
| Toluene | 13.8 | 13.8 | 0.0 | 0.0 | 13.8 | 0.0 | 0.0 |
| Ethylbenzene | 1.3 | 1.3 | 0.0 | 0.0 | 0.0 | 1.3 | 0.0 |
| Xylene | 2.5 | 2.5 | 0.0 | 0.0 | 0.0 | 2.5 | 0.0 |
| $C_9$+ aromatics | 10.5 | 10.5 | 0.0 | 0.0 | 0.0 | 0.0 | 10.5 |
| Total | 100 | 100 | 37.7 | 34.2 | 13.8 | 3.8 | 10.5 |

TABLE 2

Material balance for inventive system without a transalkylation unit (all values in kg) (shown in FIGS. 1 and 2)

| Species | In (12) | After HT (14) | After Aromatization (16) | Raffinate (24) | $C_6$-rich (22) | $C_7$-rich (28) | $C_8$-rich (38) | Aromatic Bottoms (54) |
|---|---|---|---|---|---|---|---|---|
| $H_2$ | 0.0 | 0.0 | 0.3 | 0.0 | 0.0 | 0.0 | 0.0 | 0.0 |
| $C_1$-$C_4$ | 0.0 | 0.0 | 10.6 | 0.0 | 0.0 | 0.0 | 0.0 | 0.0 |
| $C_5$+ paraffins | 19.17 | 35.36 | 6.6 | 37.7 | 0.0 | 0.0 | 0.0 | 0.0 |
| Naphthenes | 2.34 | 2.34 | 0.0 | 0.0 | 0.0 | 0.0 | 0.0 | 0.0 |
| Mono-olefins | 7.69 | 0.0 | 0.0 | 0.0 | 0.0 | 0.0 | 0.0 | 0.0 |
| Di-olefins | 8.5 | 0.0 | 0.0 | 0.0 | 0.0 | 0.0 | 0.0 | 0.0 |
| Benzene | 34.2 | 34.2 | 40.3 | 0.0 | 40.3 | 0.0 | 0.0 | 0.0 |
| Toluene | 13.8 | 13.8 | 26.3 | 0.0 | 0.0 | 26.3 | 0.0 | 0.0 |
| Ethylbenzene | 1.3 | 1.3 | 1.3 | 0.0 | 0.0 | 0.0 | 1.3 | 0.0 |
| Xylene | 2.5 | 2.5 | 2.6 | 0.0 | 0.0 | 0.0 | 2.6 | 0.0 |
| $C_9$+ aromatics | 10.5 | 10.5 | 12.0 | 0.0 | 0.0 | 0.0 | 0.0 | 10.5 |
| Total | 100 | 100 | 100 | 37.7 | 40.3 | 26.3 | 3.9 | 10.5 |

TABLE 3

Material balance for inventive system with a transalkylation unit (all values in kg) (as shown in FIGS. 1-3)

| Species | In (12) | After HT (14) | After Aromatization (16) | Raffinate (24) | $C_6$-rich (22 + 62) | $C_7$-rich (28 + 66) | $C_8$-rich (38 + 72) | Aromatic Bottoms (54 + 76) |
|---|---|---|---|---|---|---|---|---|
| $H_2$ | 0.0 | 0.0 | 0.3 | 0.2 | 0.0 | 0.0 | 0.0 | 0.0 |
| $C_1$-$C_4$ | 0.0 | 0.0 | 10.6 | 11.9 | 0.0 | 0.0 | 0.0 | 0.0 |
| $C_5$+ paraffins | 19.17 | 35.36 | 6.6 | 6.6 | 0.0 | 0.0 | 0.0 | 0.0 |
| Naphthenes | 2.34 | 2.34 | 0.0 | 0.0 | 0.0 | 0.0 | 0.0 | 0.0 |
| Mono-olefins | 7.69 | 0.0 | 0.0 | 0.0 | 0.0 | 0.0 | 0.0 | 0.0 |
| Di-olefins | 8.5 | 0.0 | 0.0 | 0.0 | 0.0 | 0.0 | 0.0 | 0.0 |
| Benzene | 34.2 | 34.2 | 40.3 | 0.0 | 53.9 | 0.0 | 0.0 | 0.0 |
| Toluene | 13.8 | 13.8 | 26.3 | 0.0 | 0.0 | 0.0 | 0.0 | 0.0 |
| Ethylbenzene | 1.3 | 1.3 | 1.3 | 0.0 | 0.0 | 0.0 | 0.0 | 0.0 |
| Xylene | 2.5 | 2.5 | 2.6 | 0.0 | 0.0 | 0.0 | 21.1 | 0.0 |
| $C_9$+ aromatics | 10.5 | 10.5 | 12.0 | 0.0 | 0.0 | 0.0 | 0.0 | 12.0 |
| Total | 100 | 100 | 100 | 18.7 | 53.9 | 0 | 21.1 | 12.0 |

As shown in the Tables, without the aromatization unit, 51.8 kg of BTX (34.2 kg+13.8 kg+3.8 kg) are simulated to be produced from 100 kg of a pygas feedstock. However, by introducing an aromatization unit, 70.5 kg of BTX (40.3 kg+26.3 kg+1.3 kg) when no transalkylation unit is used and 75 kg of benzene and xylenes (53.9 kg+21.2 kg) when a transalkylation unit is used may be produced from 100 kg of a pygas feedstock. Also, notably, when the transalkylation unit is used, the conversion of toluene to benzene and xylene produced greater amounts of benzene and xylene, and consequently resulted in no toluene yield.

It is noted that recitations in the present disclosure of a component of the present disclosure being "operable" or "sufficient" in a particular way, to embody a particular property, or to function in a particular manner, are structural recitations, as opposed to recitations of intended use. More specifically, the references in the present disclosure to the manner in which a component is "operable" or "sufficient" denotes an existing physical condition of the component and, as such, is to be taken as a definite recitation of the structural characteristics of the component.

Having described the subject matter of the present disclosure in detail and by reference to specific embodiments, it is noted that the various details disclosed in the present disclosure should not be taken to imply that these details relate to elements that are essential components of the various embodiments described in the present disclosure. Further, it will be apparent that modifications and variations are possible without departing from the scope of the present disclosure, including, but not limited to, embodiments defined in the appended claims.

The singular forms "a", "an" and "the" include plural referents, unless the context clearly dictates otherwise.

Throughout this disclosure ranges are provided. It is envisioned that each discrete value encompassed by the ranges are also included. Additionally, the ranges which may be formed by each discrete value encompassed by the explicitly disclosed ranges are equally envisioned.

As used in this disclosure and in the appended claims, the words "comprise," "has," and "include" and all grammatical variations thereof are each intended to have an open, non-limiting meaning that does not exclude additional elements or steps.

As used in this disclosure, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that the mere use of the term "first" and "second" does not require that there be any "third" component, although that possibility is contemplated under the scope of the present disclosure.

What is claimed is:

1. A method for producing aromatic compounds from pyrolysis gasoline, the method comprising:

hydrotreating a stream comprising the pyrolysis gasoline to produce a hydrotreated pyrolysis gasoline stream comprising an increased amount of paraffins and a decreased amount of olefins relative to the stream comprising the pyrolysis gasoline;

aromatizing the hydrotreated pyrolysis gasoline stream to produce a stream comprising a mixture of benzene, toluene, and xylenes (BTX), wherein the paraffins are at least partially converted to BTX; and processing the stream comprising BTX in an aromatics recovery complex, thereby producing the aromatic compounds from the pyrolysis gasoline, wherein the aromatizing the hydrotreated pyrolysis gasoline stream occurs in the absence of hydrogen.

2. The method of claim 1, wherein the aromatics recovery complex does not comprise a transalkylation unit.

3. The method of claim 2, further comprising transalkylating the stream comprising BTX prior to the processing.

4. The method of claim 1, wherein the aromatics recovery complex comprises a transalkylation unit.

5. The method of claim 4, wherein the stream comprising BTX further comprises $C_9$-$C_{10}$ aromatic compounds and the transalkylation unit converts the toluene and the $C_9$-$C_{10}$ aromatic compounds to benzene and xylenes.

6. The method of claim 1, wherein the aromatizing comprises one or more of cyclization and dealkylation reactions.

7. The method of claim 1, wherein the aromatizing is performed in a reactor having a temperature from 200° C. to 900° C.

8. The method of claim 1, wherein the aromatizing is performed in a reactor having a weight hourly space velocity from 0.1 $h^{-1}$ to 20 $h^{-1}$.

9. The method of claim 1, wherein the aromatizing is performed in a reactor having a pressure from 0.1 MPa to 3 MPa.

10. The method of claim 1, wherein the aromatizing comprises contacting the hydrotreated pyrolysis gasoline stream with a catalyst comprising a Y zeolite, a ZSM-5 zeolite, or a combination of the Y zeolite and the ZSM-5 zeolite.

11. The method of claim 1, wherein the aromatics recovery complex further produces $C_5$-$C_6$ non-aromatic compounds.

12. The method of claim 11, further comprising:

aromatizing the $C_5$-$C_6$ non-aromatic compounds, thereby producing additional BTX, the additional BTX being added to the stream comprising BTX.

13. The method of claim 1, wherein hydrotreating the stream comprising the pyrolysis gasoline causes at least a 99.9 wt. % decrease in an olefin content in the hydrotreated pyrolysis gasoline relative to the pyrolysis gasoline.

14. The method of claim 1, wherein the aromatizing comprises contacting the hydrotreated pyrolysis gasoline stream with a catalyst consisting of zeolites.

15. The method of claim 1, wherein hydrotreating the pyrolysis gasoline stream comprises removing di-olefins and subsequently removing mono-olefins.

16. The method of claim 15, wherein removing di-olefins comprises contacting hydrocarbons from the pyrolysis gasoline with a hydrotreating catalyst and hydrogen at a temperature of from 160° C. to 220° C.

17. The method of claim 15, wherein removing di-olefins comprises contacting hydrocarbons from the pyrolysis gasoline with a hydrotreating catalyst and hydrogen at a hydrogen partial pressure of from 1 to 2 MPa.

18. The method of claim 15, wherein removing mono-olefins comprises contacting hydrocarbons from the pyrolysis gasoline with a hydrotreating catalyst and hydrogen at a temperature of from 270° C. to 330° C.

19. The method of claim 15, wherein removing mono-olefins comprises contacting hydrocarbons from the pyrolysis gasoline with a hydrotreating catalyst and hydrogen at a hydrogen partial pressure of from 1 to 2 MPa.

* * * * *